US005090434A

United States Patent [19]

Hagen

[11] Patent Number: 5,090,434

[45] Date of Patent: Feb. 25, 1992

[54] CHAIR ASSEMBLY FOR RELEASABLE ATTACHMENT TO CRUTCH

[76] Inventor: Elmer R. Hagen, 230 W. Genesee St., Apt. 3, Auburn, N.Y. 13201

[21] Appl. No.: 619,079

[22] Filed: Nov. 28, 1990

[51] Int. Cl.[5] ..... A45B 3/00

[52] U.S. Cl. ..... 135/66; 248/155

[58] Field of Search ..... 248/155.1, 155.2, 155.3, 248/155.4, 155.5; 135/66; 297/217

[56] References Cited

U.S. PATENT DOCUMENTS

| | | | |
|---|---|---|---|
| 180,074 | 7/1876 | Skinner | 248/155.2 |
| 642,954 | 2/1900 | Bois | 248/155.4 |
| 751,942 | 2/1904 | Renno | 248/155 |
| 979,959 | 12/1910 | Johnson | 135/66 |
| 1,463,675 | 7/1923 | Coleman | 135/68 |
| 2,766,813 | 10/1956 | Kay | 248/155.5 |
| 2,991,035 | 7/1961 | Packett | 248/155 |
| 3,537,748 | 11/1970 | Knapp | 248/155 |
| 4,910,927 | 3/1990 | Beatty | 135/68 |

*Primary Examiner*—Henry E. Raduazo
*Attorney, Agent, or Firm*—Katherine McGuire

[57] ABSTRACT

A seat assembly for releasable attachment to the center post of a conventional crutch comprises a planar sitting board with a support board hingedly attached thereto. In a first embodiment, a sleeve is affixed to a hinge which is affixed to the back edge of the sitting board. The sleeve may be slidingly fit over the top end of the crutch center post and thereby maintain the seat assembly in the open, ready position wherein the sitting board is substantially horizontal and the crutch and support board are vertically oriented, being spaced apart by the sitting board. In a second embodiment, a bracket having a pair of grooves is attached to the sitting board and attaches to a pair of spaced bolts affixed to the crutch center post. Additional securing means are provided in the form of a stabilizer rod extending from the center post to the support board.

12 Claims, 2 Drawing Sheets

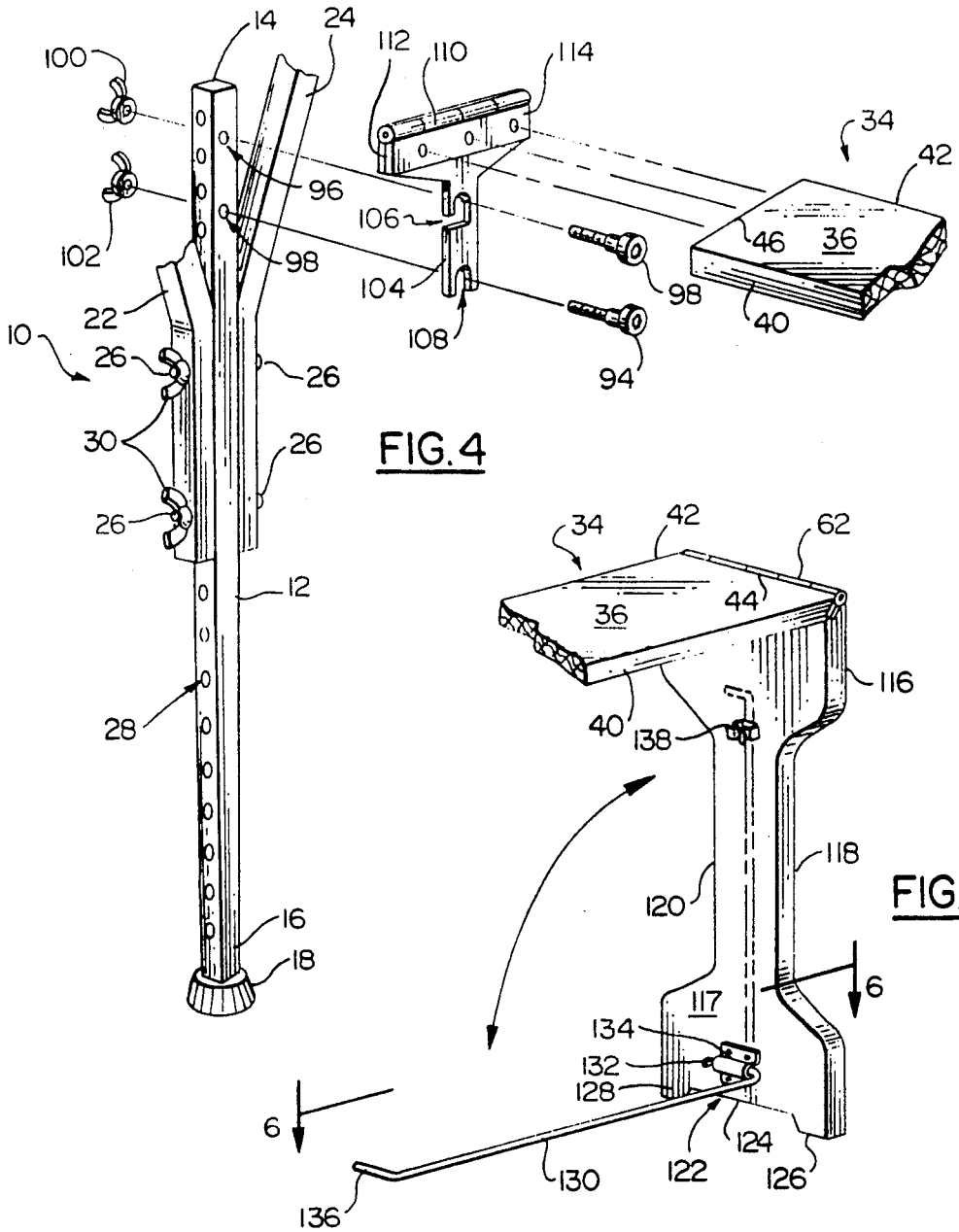
FIG. 4
FIG. 5
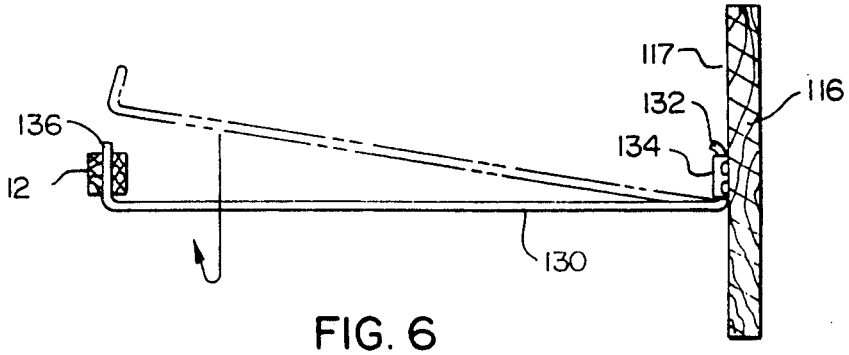
FIG. 6

CHAIR ASSEMBLY FOR RELEASABLE ATTACHMENT TO CRUTCH

BACKGROUND OF THE INVENTION

This invention relates to accessory equipment for crutches for the infirm and, more particularly, to a novel and unique, collapsible seat assembly for releasable attachment to a crutch.

There has been a long and ongoing effort to ease the burden of those needing the assistance of equipment for the disabled such as canes, walkers, wheelchairs, crutches, and the like. Improved designs are continuously sought to improve the comfort of the patient. In the area of accessories for such standard equipment listed above, it has long been realized that a built-in or otherwise attachable seat is ideal for crutches since crutches by design are very awkward and tiresome to use. For the patient to be able to quickly convert his or her crutch or crutches into a resting seat is of great convenience, especially so when there are no other seating places to be found when exhaustion strikes. Examples of such crutch seats may be seen in U.S. Pat. Nos. 1,463,675 and 1,521,536. The crutch seat disclosed in the '536 patent requires a bi-legged crutch which is not in standard use today. Also, in the uni-legged crutch seat of the '675 patent, a wall support is required to balance the seat for sitting purposes. There is thus a need for a seat attachment for a crutch of present day, uni-legged design which is quick and easy to assemble and may be used with no vertical wall support needed.

It is therefore a main object of the present invention to provide a collapsible seat assembly for releasable attachment to a conventional crutch.

It is a further object to provide an improved crutch seat assembly which may be quickly and easily attached to and removed from the center post of a crutch.

It is another object to provide an improved crutch seat assembly in which the crutch, in combination with the seat assembly in the attached, open position, provides a stable, stationary seat for the patient.

Other objects will in part be obvious and in part appear hereinafter.

SUMMARY OF THE INVENTION

In accordance with the foregoing objects, the invention comprises a seat assembly for releasable attachment to the center post of a crutch, the seat assembly including a planar surfaced sitting board with a planar support board hingedly attached thereto. The sitting board includes means hingedly attached to the end opposite to which the support board is attached for the releasable attachment of the seat assembly to the center post of the crutch. In the attached, open position, the sitting and support boards assume a perpendicular posture relative to each other, with the support board standing vertically from the floor and the sitting board extending horizontally between the crutch and top of the support board.

Although the pair of hinge elements which respectively secure the support board to the sitting boards and the sitting board to the member which releasably attaches the sitting board to the crutch, are effective in preventing lateral play or front and back motion of the seat assembly when in the open position, additional stabilizing means are provided in the form of an elongated stabilizing rod which may be releasably attached adjacent the base of the crutch center post at one end thereof, and releasably attached adjacent the base of the support board at the opposite end thereof. When it is desired to remove the seat assembly from the crutch, the sitting board detaches easily from the center post of the crutch with no tools required for its removal. Likewise, the stabilizing rod detaches from the center post and may be either detached from the support board at the other end, or laid flat against and releasably secured to the support board. The support board may then be pivoted about its hinge element to fold against the sitting board which may be easily carried as a unit by hand or in a backpack, for example.

BRIEF DESCRIPTION OF THE DRAWINGS

FIG. 4 is an exploded, perspective view of selected portions of a second embodiment of the invention showing the crutch and sitting board partly broken away;

FIG. 5 is a perspective view of the portion of the seat assembly which is broken away in FIG. 4; and FIG. 6 is an elevated, cross-sectional view of the seat assembly as taken along the line 6—6 in FIG. 5.

DETAILED DESCRIPTION

Figure 1:
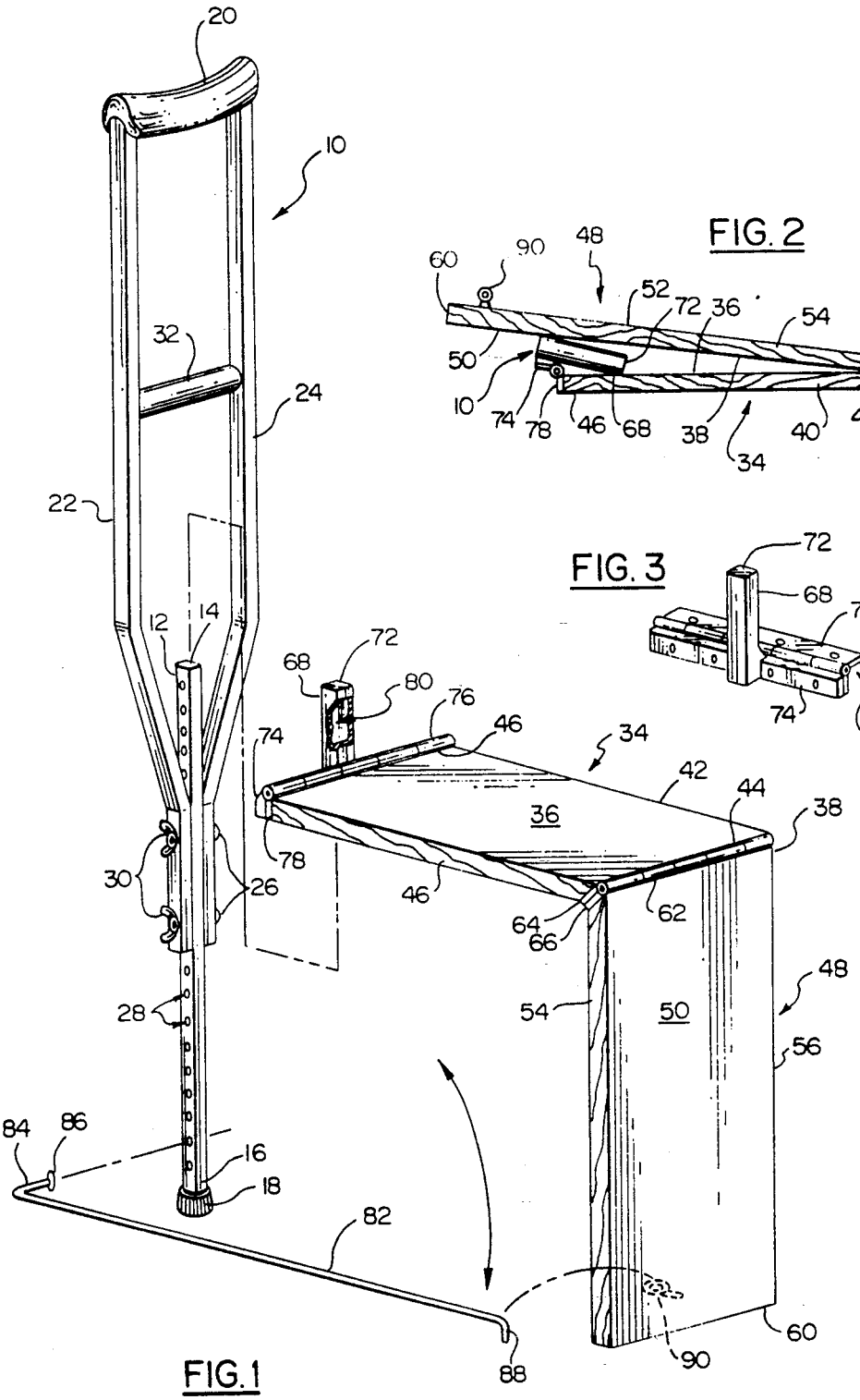
FIG. 1 is an exploded, perspective view showing a first embodiment of the invention.

Referring now to the drawings, there is seen in the various Figures a conventional crutch 10 in wide use today having a center post 12 with top end 14 and bottom end 16 including rubber stop 18. Crutch 10 is seen to further include under-arm support 20 having spaced crutch members 22 and 24 extending downwardly from opposite ends thereof which taper inwardly to engage opposite sides of center post 12. Bolts 26 pass through holes 28 in center post 12 and associated wing-nuts 30 secure center post 12 to crutch members 22 and 24. As seen, a plurality of such holes 28 are linearly spaced along the full length of center post 12 such that crutch members 22 and 24 may be aligned with selected holes 28 which permit the height of crutch 10 to be adjusted to the height of the patient. In standard use of crutch 10, support 20 is positioned under an arm of the patient with the patient supporting him or herself on under-arm support 20 while grasping handle 32. Having thus described the type of crutch 10 to be used in combination with the invention, the seat assembly will now be described in more detail.

The seat assembly comprises sitting board 34 of rectilinear configuration, having a planar sitting surface 36, bottom surface 38, side edges 40, 42 and front and back edges 44, 46, respectively. Although not shown in the drawings, sitting surface 36 may include optional padding, as desired, to increase the comfort of the patient. In the embodiment seen in FIG. 1, similarly shaped, rectilinear support board 48 includes planar front and back surfaces 50, 52, respectively, side edges 54, 56 and top and bottom edges 58, 60, respectively, it being readily seen in FIG. 2 that support board 48 is preferably longer than seating board 34. Both sitting board 34 and support board 48 are constructed of a rigid, lightweight material such as ABS or wood, for example, although any suitable, rigid material may be used in the construction of sitting board 34 and support board 48.

Sitting board 34 is attached at front edge 44 to top edge 58 of support board 48 by elongated hinge element 62 which attaches to mitered edges 44 and 58 of the respective boards via like hinge plates 64 and 66, respectively. As such, support board 48 may pivot 270° about hinge element 62, from the open position seen in FIG. 1 in which support board 48 is positioned perpendicular to sitting board 34, to a folded position wherein front surface 50 of support board 48 is in covering contact with front surface 36 of sitting board 34. In FIG. 2, support board 48 has been pivoted approximately 260° from the position seen in FIG. 1 as will be more fully understood below.

Figure 2:
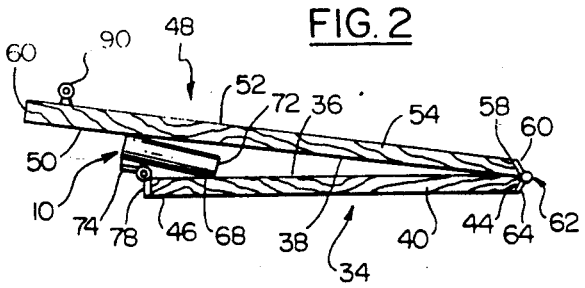
FIG. 2 is a side, elevational view of the seat assembly seen in FIG. 1 shown here in its detached, folded position.
Figure 3:
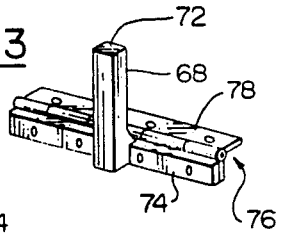
FIG. 3 is a perspective view showing the hinge and sleeve element of the seat assembly seen in FIG. 1 which releasably attaches the seat assembly to the center post of the crutch.

Means for the releasable attachment of sitting board 34 to crutch 10 is provided in the embodiment seen in FIGS. 1–3 in the form of a sleeve 68 having an open end 70 and opposite, closed end 72. Sleeve 68 is attached to hinge plate 74 of hinge 76 adjacent open end 70 while opposite hinge plate 78 is attached to rear edge 46 of sitting board 36. As such, sleeve 68 may pivot about hinge 76 from the position seen in FIG. 1 wherein hinge plate 74 lies in covering relation to hinge plate 78, to the position seen in FIG. 2 wherein hinge plates 74 and 78 are spaced approximately 90° from each other and sleeve 68 is positioned between sitting board 34 and support board 48. As seen in FIG. 1 wherein sleeve 68 is shown partly broken away, sleeve 68 is hollow having internal channel 80 extending from open bottom 70 to closed top 72, channel 80 having substantially the same outline as crutch center post 12 adjacent top end 14. To attach the seat assembly to crutch 10, support board 48 is pivoted to assume an approximately 90° angle with sitting board 34 with bottom edge 60 placed upon the floor such that support board 48 is vertical and sitting board 34 is horizontal and extends between crutch 10 and top edge 58 of support board 48. Sleeve 68 is then pivoted such that hinge plate 76 lays flat against hinge plate 78 as seen in FIG. 1. In this position, sleeve 68 lies substantially parallel to support board 48. The top end 14 of crutch center post 12 is slidably inserted into internal channel 80 of sleeve 68 via open end 70, closed end 72 of sleeve 68 acting as a stop when post top end 14 abutts it upon full insertion of crutch center post top end 14 into sleeve 68.

As aforementioned, additional seat assembly securing means is provided in the form of an elongated stabilizer rod 82 which is releasably attached to crutch center post 12 adjacent bottom end 16 via rod end 84 which is bent approximately 90° from rod 82. Rod end 84 includes lock element 86 which pivots about its attachment pin to assume a position colinear with rod end 84 (not shown) such that both lock 86 and rod end 84 may pass through a hole 28 adjacent center post bottom end 16. Lock element 86 may thereafter be manually turned to the position seen in FIG. 1 to prevent movement of rod end 84 out of hole 28. With rod end 84 in position within hole 28 in accordance with the description above, rod 82 may pivot vertically in accordance with the directional arrows seen in FIG. 1. As seen, rod end 88 which is located opposite end 84 is also bent approximately 90° from rod 82 in a direction facing downwardly and perpendicular to rod end 84. Support board 48 includes eye screw 90 attached to back surface 52 and rod 82 is pivoted to insert and secure end 88 into eye screw 90.

When it is desired to remove the sitting assembly from crutch 10, rod 82 is removed by pulling rod end 88 out of eye screw 90 and rod end 84 out of hole 28 by turning lock element 86 until it is colinear with rod end 84. Sleeve 68 may then be slidingly removed from center post end 14 and pivoted to lie against sitting board surface 36 while support board 48 is pivoted in a direction toward sitting board surface 36 to assume the folded position seen in FIG. 2.

Turning attention now to the embodiment seen in FIGS. 4–6, alternate means are provided for releasably attaching the seat assembly to the crutch center post 12. In particular, a pair of bolts 92, 94 are passed through a pair of spaced bore holes 96, 98 which run perpendicular to holes 28 in center post 12. Bolts 92, 94 are secured within holes 96, 98 by respective wing nuts 100, 102. Bolts 92, 94 are provided to support mounting bracket 104 which includes grooves 106 and 108 for insertion onto the exposed necks of secured bolts 92, 94, respectively. It is seen that groove 106 is generally L-shaped which tends to prevent mounting bracket 104 from moving about bolts 96 and 98. Bracket 104 is attached to hinge 110 at hinge plate 112 while rear edge 46 of sitting board 34 is bolted or otherwise fixedly attached to opposite, like hinge plate 114, both plates 112, 114 being able to pivot about hinge 110.

A support board 116 is pivotally attached via hinge 62 to the front edge 44 of sitting board 34 in the same manner as support board 48 seen in FIGS. 1–3. Support board 116 has tapered edges 118, 120 which design reduces the overall weight of the seat assembly. It is seen that bottom edge 122 of support board 116 also includes a tapered edge 124, thereby forming two leg portions 126, 128.

A securing rod 130 is provided which includes a 90° bent end 132 which is fixedly received in bracket 134 which is attached to back surface 117 of support board 116. Opposite end 136 is also bent approximately 90° from rod 130 and is coplanar with end 132 unlike the respective end configurations of rod 82 seen in FIGS. 1–3. To attach rod 130 to center post 12, rod 130 may bend and pivot as seen in FIG. 6 such that end 136 may be inserted into a hole 28 located adjacent center post bottom end 16. When it is desired to remove the seat assembly from crutch 10, end 136 is removed from hole 28 by pulling on rod 130 in a direction away from center post 12. Rod 130 may then be moved vertically upward in accordance with the directional arrow seen in FIG. 5 since end 132 may axially rotate within bracket 134. Rod 130 may then be releasably secured to support board 116 by insertion into spring clasp 138. Sitting board 34 and bracket 104 are removed from center post 12 by releasing grooves 106, 108 from respective bolts 92, 94. Sitting board 34 is foldable against support board 116 in the same manner as described for the embodiment seen in FIGS. 1–3.

It is to be understood that the seat assembly elements described in the two embodiments seen in FIGS. 1–3 and FIGS. 4–6 are interchangeable. For example, sitting board 116 seen in the embodiment of FIG. 5 may be interchanged with sitting board 48 seen in FIGS. 1 and 2 and vice versa. The same is true of bracket 104 and sleeve 68, and securing rod 82 and securing rod 130, i.e., each is interchangeable with the other.

It will be appreciated from the foregoing that there is thus provided an extremely simple and inexpensive seat assembly for attachment to the center post of a crutch which will be the source of much convenience to a tired patient. It is obvious that various changes and modifications may be made in the details of construction and design of the above specifically described embodiments of this invention without departing from the spirit thereof, such changes and modifications being restricted only by the scope of the following claims.

What is claimed is:

1. A seat assembly for releasable attachment to the top, terminal end of a center post of a crutch, said assembly comprising:

a.) a sitting board having a substantially planar sitting surface with front, back and first and second, opposite side edges;

b.) a support board having substantially planar front and back surfaces with top, bottom and first and second, opposite side edges;

c.) a first elongated hinge having first and second, superposable hinge plates of like configuration, each of said hinge plates being independently axially rotatable about said first hinge, said first hinge plate fixedly attached to said sitting board front edge and said second hinge plate being fixedly attached to said support board top edge whereby said support board may be pivoted from an open position wherein said support board is perpendicular to said sitting board, to a folded position wherein said support board front surface is in covering, contacted relation with said sitting board sitting surface; and d.) means on said sitting board back edge for releasably attaching said sitting board to said crutch center post such that said sitting board extends substantially perpendicular to said crutch center post with said support board extending vertically from said sitting board in said open position.

2. The invention according to claim 1 wherein said sitting board releasable attachment means comprises a sleeve having a closed top end, open bottom end and an internal channel extending between said closed top end and open bottom end and configured to snugly and slidingly receive said crutch center post top, terminal end through said sleeve open bottom.

3. The invention according to claim 2 and further including a second elongated hinge having first and second, superposable hinge plates of like configuration, each of said second hinge first and second plates being independently axially rotatable about said second hinge and wherein said sleeve is fixedly attached adjacent said open bottom end to substantially the center of said second hinge first plate and wherein said second hinge second plate is fixedly attached to said sitting board back edge.

4. The invention according to claim 3 and further comprising an elongated stabilizing rod having first and second, opposite ends, said rod first end including means to releasably attach to said crutch center post adjacent the end thereof opposite said top, terminal end, said rod second end including means to releasably attach to said support board back surface adjacent said support board bottom edge in said open position thereof whereby said rod extends substantially parallel to said sitting board between said crutch center post and said support board.

5. The invention according to claim 4 wherein said crutch center post includes a plurality of parallel, linearly spaced bores extending in a direction parallel to said sitting board back edge when said sitting board is releasably attached to said center post, said bores extending from said center post top, terminal end to said opposite end thereof, and wherein said rod first end attaching means comprises a segment of said rod first end integrally and linearly extending in a direction substantially 90° away from said elongated rod for releasable insertion thereof through one of said plurality of said bores adjacent said crutch center post opposite end wherein said rod first end extension is axially rotatable within said one of said bores, and wherein said rod second end securing means comprises a segment of said rod second end integrally and linearly extending in a direction substantially 90° away from said elongated rod and substantially perpendicular to said rod first end segment, said support board rear surface further including an eye screw affixed thereto adjacent said bottom edge for releasable insertion of said rod second end segment therein.

6. The invention according to claim 5 wherein said rod first end segment includes a lock element manually movable between an unlocked position, wherein said lock element is substantially colinear with said rod first end segment, and a locked position, wherein said lock element is substantially perpendicular to said rod first end segment.

7. The invention according to claim 1 wherein said sitting board releasable attachment means comprises:

a.) a pair of bolts secured with a respective pair of vertically spaced holes in said crutch center post; and b.) a planar bracket having two vertically spaced grooves configured for insertion over and releasable securement to said bolts.

8. The invention according to claim 7 wherein a first of said two grooves is linearly shaped and a second of said two grooves is L-shaped.

9. The invention according to claim 7 and further including a second elongated hinge having first and second, superposable hinge plates of like configuration, each of said first and second plates being independently axially rotatable about said second hinge and wherein said bracket is fixedly attached to substantially the center of said second hinge first plate and wherein said second hinge second plate is fixedly attached to said sitting board back edge.

10. The invention according to claim 9 and further comprising an elongated stabilizer rod having first and second, opposite ends, said rod first end including means to releasably attach to said crutch center post adjacent the end thereof opposite said top, terminal end, said rod second end including means to attach to said support board back surface adjacent said support board bottom edge in said open position thereof whereby said rod extends substantially parallel to said sitting board between said crutch center post and said support board.

11. The invention according to claim 10 wherein said crutch center post includes a plurality of parallel, linearly spaced bores extending in a direction parallel to said sitting board back edge when said sitting board is releasably attached to said center post, said bores extending from said center post top, terminal end to said opposite end thereof, and wherein said rod first end attaching means comprises a segment of said rod first end integrally and linearly extending in a direction substantially 90° away from said elongated rod for releasable insertion thereof through one of said plurality of said bores adjacent said crutch center post opposite end, and wherein said rod second end securing means comprises a segment of said rod second end integrally and linearly extending in a direction substantially 90° away from said elongated rod and substantially coplanar with said rod first end segment, said support board rear surface further including a second bracket affixed thereto for fixedly receiving said rod second end segment therein wherein said rod second end segment is axially rotatable within said second bracket.

12. The invention according to claim 11 and further including a spring biased clasp fixedly attached to said support board rear surface to receive and releasably secure said stabilizer rod adjacent said first end in covering contact to said support board rear surface.

* * * * *